US006398333B1

(12) United States Patent
Mulay et al.

(10) Patent No.: US 6,398,333 B1
(45) Date of Patent: Jun. 4, 2002

(54) PRINT HEAD TEMPERATURE ADJUSTMENT BASED ON MEDIA TYPE

(75) Inventors: Shirish Padmakar Mulay; Duane Edward Norris, both of Lexington; Julie Ann Gordon Whitney, Georgetown; Agnes Kam Zimmer, Lexington, all of KY (US)

(73) Assignee: Lexmark International, Inc, Lexington, KY (US)

( * ) Notice: Subject to any disclaimer, the term of this patent is extended or adjusted under 35 U.S.C. 154(b) by 0 days.

(21) Appl. No.: 09/634,977

(22) Filed: Aug. 9, 2000

(51) Int. Cl.[7] ..... B41J 2/01
(52) U.S. Cl. ..... 347/14; 347/17
(58) Field of Search ..... 347/14, 16, 17, 347/19, 15

(56) References Cited

U.S. PATENT DOCUMENTS

| | | | | |
|---|---|---|---|---|
| 4,617,580 A | | 10/1986 | Miyakawa | |
| 4,719,472 A | | 1/1988 | Arakawa | |
| 4,829,323 A | * | 5/1989 | Suzuki et al. | 347/15 |
| 4,910,528 A | | 3/1990 | Firl et al. | |
| 5,504,506 A | | 4/1996 | Noaki | |
| 5,638,098 A | | 6/1997 | Iwata et al. | |
| 5,673,069 A | | 9/1997 | Canfield et al. | |
| 5,745,132 A | | 4/1998 | Hirabayashi et al. | |
| 5,760,797 A | | 6/1998 | Koizumi et al. | |
| 5,764,251 A | * | 6/1998 | Hashimoto | 347/16 |
| 5,774,145 A | | 6/1998 | Mizutani | |
| 5,801,722 A | | 9/1998 | Ueda et al. | |
| 5,812,156 A | | 9/1998 | Bullock et al. | |

* cited by examiner

*Primary Examiner*—Craig A. Hallacher
(74) *Attorney, Agent, or Firm*—Luedaka, Neely & Graham, P.C.

(57) ABSTRACT

The invention provides a printing apparatus for printing an image having a spatial resolution onto a print medium. The printing apparatus includes a printhead having a plurality of printing elements for ejecting ink droplets having a mass onto the print medium, and a temperature sensor for sensing a temperature of the printhead, producing a temperature signal. The apparatus also includes a media sensor for determining what type of print medium is loaded in the printer and producing a print medium signal based on the type of print medium installed in the printer. A plurality of heating devices are located adjacent the printhead for adjusting the temperature the printhead. The apparatus includes a printer controller for receiving the temperature signal from the temperature sensor and the print medium signal from the media sensor, and determines the ink temperature based on the print medium signal, and activates the heating devices to maintain the temperature of the printhead within a desired temperature range that is dependent upon the print medium signal.

20 Claims, 5 Drawing Sheets

PRINT HEAD TEMPERATURE ADJUSTMENT BASED ON MEDIA TYPE

TECHNICAL FIELD

The invention relates generally to print quality control within an ink jet printer. More particularly, the invention relates to adjusting the print quality of an ink jet printer based on the print head temperature and the media type used during printing.

BACKGROUND OF THE INVENTION

Ink jet printers are becoming much more common as the printer of choice because of their relatively low cost compared to laser printers and the ability of ink jet printers to produce multi-color images on a variety of media types at reasonable costs per printed sheet. Recent improvements in ink jet printers include improvements in the print heads and the ink cartridges and improved or specialized ink formulations. These improvements have led to improved print quality which results in the ability to produce high quality and/or photographic images. As the use of ink jet printers continues to expand, the need to produce images on a variety of print media has also expanded.

For many applications, the type of print media used in an ink jet printer has little effect on the usefulness of the resulting printed product. However, for certain applications, it is important to identify the media being used for the printing operation. That is, ink spread varies depending on the type of media. For example, plain paper allows the ink to wick into the paper fibers which tends to create a larger spot. On the other hand, coated and glossy types of paper tend to keep the ink spot well rounded, not allowing the ink to spread. As a result, spots tend to be smaller on higher quality media than on plain paper for the same ink drop mass. As drop mass increases, spot size also increases. Drop mass can be controlled within limits by adjusting the ink temperature before firing. It is desirable to optimize the spot sizes so that they are substantially the same regardless of the media type used in the printing application.

Ink jet printers have the capability of printing on a variety of media types, from glossy paper to overhead projection media to plain paper. The variety of printable media places a demand on ink jet printer manufacturers and designers to print quality images on the full gamut of media types without losing print quality or speed. As described above, ink spreads differently depending on the media type used in the printer, which makes ink spot size optimization difficult when using media of varying characteristics. Furthermore, ink droplet misdirection may be exacerbated due to the media type used during the printing application. Ink droplet misdirection is a function of the ink temperature which determines the ink drop exit velocity. Faster exiting ink drops tend to be less misdirected when printed.

What is needed, therefore, is a method and apparatus to control ink drop properties based on temperature and media.

SUMMARY OF THE INVENTION

The foregoing and other needs are met by a printing apparatus and method for controlling the ink droplet mass of the ink ejected from the nozzles of a printhead in an ink jet printer. The printing apparatus is used for printing a desired image having a spatial resolution onto a print medium. The printing apparatus includes a printhead having a plurality of printing elements for ejecting ink droplets having a mass onto the print medium, and a temperature sensor for sensing a temperature of the printhead and producing a temperature signal. The apparatus also includes a media sensor for determining what type of print medium is loaded in the printer and producing a print medium signal based on the type of print medium installed in the printer. A plurality of heating devices are located adjacent the printhead for adjusting the temperature of the printhead. The apparatus includes a printer controller for receiving the temperature signal from the temperature sensor and the print medium signal from the media sensor, for determining the temperature of the ink based on the print medium signal, and for activating the heating devices to maintain the temperature of the printhead within a desired temperature range that is dependent upon the print medium signal.

In another aspect, the invention provides a method for adjusting the characteristics of ink droplets ejected from an inkjet printhead to form dots on a print medium. The dots printed during multiple passes of the printhead across the print medium form a printed image on the print medium. The method includes sensing a print medium type and sensing a printhead temperature. Moreover, the printer controller determines, based on the print medium type, an optimal temperature range in which to maintain the printhead temperature and maintains the printhead temperature within the optimal temperature range. The image is printed by ejecting the ink droplets from the printhead as the printhead passes across the print medium to form the printed image.

BRIEF DESCRIPTION OF THE DRAWINGS

Further advantages of the invention will become apparent by reference to the detailed description when considered in conjunction with the figures, wherein like reference numbers indicate like elements through the several views, and wherein.

DETAILED DESCRIPTION OF THE INVENTION

Figure 1:
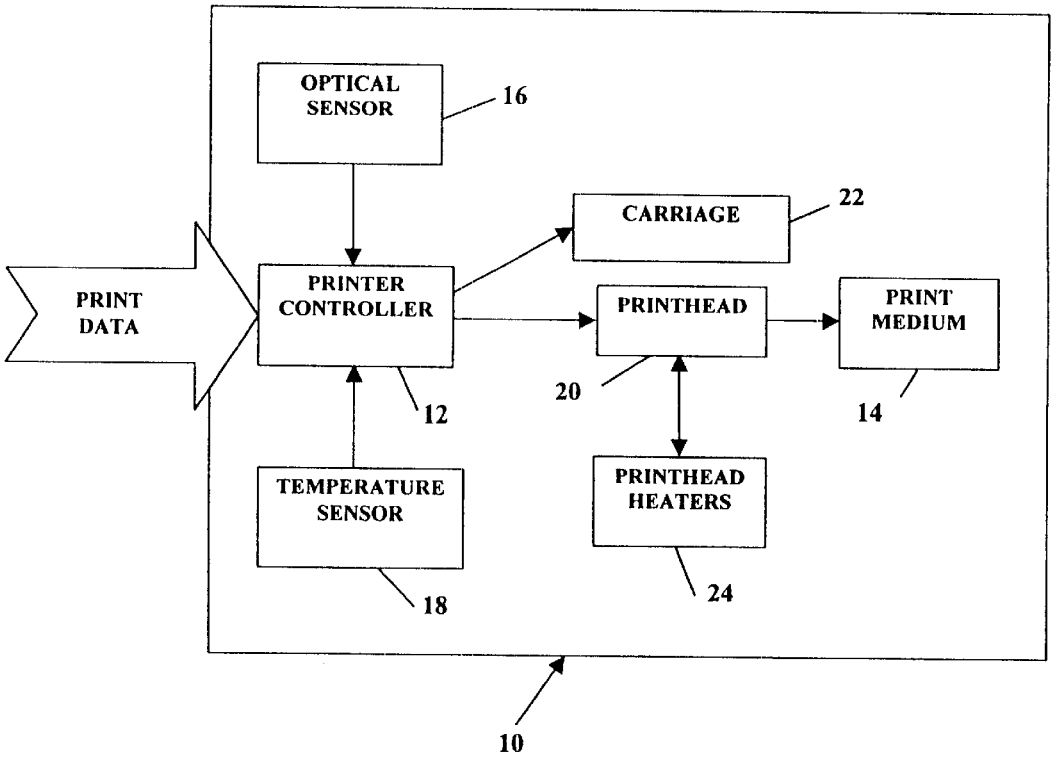
FIG. 1 is a functional block diagram of a printer utilizing two sensor inputs according to a preferred embodiment of the invention.

Depicted in FIG. 1 is block diagram of a printer 10 which is controlled by a printer controller 12 for printing images onto a print medium 14. The printer controller 12 receives image data or print data from a data source, preferably a host computer, such as an IBM personal computer (PC) or a network host. According to the invention, the printer controller 12 utilizes inputs from a media sensor 16 and a printhead temperature sensor 18, to control the amount of ink output from a plurality of nozzles located adjacent to a silicon substrate in a printhead 20, thereby printing a desired image onto the print medium 14.

The media sensor 16 is preferably an optical sensor, for example, an infra-red (IR) light-emitting diode (LED) and optical detector set to reflect off of the print medium 14. The optical sensor 16 may be a light diode sensor, wherein light is transmitted from the sensor by an LED, for example, reflected by the print medium 14 and received by the sensor. Preferably, the optical sensor 16 is a near IR optical sensor transmitting an IR signal, such as the QEC 113 (GaAs Infrared Emitting Diode), and utilizing a two channel detector, such as the QSC 113 (Silicon Phototransistor), both manufactured by QT Optoelectronics of Sunnyvale, CAlif., for determining amounts of spectral and diffuse reflectivities reflected from the print medium 14. As used herein, spectral reflectivity is referred as a band of frequencies within the spectrum of transmitted light. The received spectral and diffuse reflectivities are compared to a standard, preferably in the form of a look-up table. The look-up table or standard is generated by calibrating the media sensor 16 with a variety of media types.

Preferably, the printhead temperature sensor 18 is a thermistor-type temperature sensing device. In a preferred embodiment, the temperature sensor 18 is a thermal sense resistor (TSR) embedded on the silicon substrate. Moreover, it is preferred that the TSR is formed in a serpentine fashion on the periphery of the silicon substrate. The resistance of the TSR varies with temperature at about 100 ohms per 10 degrees. Since the ink is located adjacent to the substrate, the TSR is operable to determine the ink temperature.

Firing resistors are located adjacent to the nozzles which transfer heat into the ink when it is time to print, thereby forming a bubble in the ink, expelling ink from the nozzles onto the print medium 14. The ink firing resistors are preferably a layer of material, such as tantalum, aluminum, or silicon oxide, deposited on a silicon substrate. The printer controller 12 controls the amount of energy supplied to the firing resistors which is a factor in determining the ink bubble size and heat generation. The printer 10 may contain one monochromatic printhead 20 or a plurality of multicolored printheads 20.

The printhead 20 is attached to a printhead carriage 22 which translates the printhead 20 across the print medium 14 as ink is ejected from the nozzles. Accordingly, the print resolution of printer 10 is defined as the number of ink droplets laid down per unit area as the carriage 22 translates across the print medium 14. Generally, as the print mode changes from a lower to a higher resolution, the number of shingling passes that the carriage 22 makes increases, printing a greater number of droplets per unit area. Moreover, more shingling passes are made for the higher resolution print modes to reduce banding effects. According to the invention, by adjusting the printhead temperature to control the ink droplet mass, the print quality is optimized regardless of the number of shingling passes. The invention adjusts spot size to be roughly equivalent for all media types and printing modes by matching drop mass to the wicking properties of the media. That is, the resulting ink dot size on the print medium is optimized according to the sensed print medium and adjusted printhead temperature.

Preferably, a number of printhead heaters 24 are located adjacent to the printhead 20 for heating the printhead 20. The printhead heaters 24 may include a plurality of resistive heating elements selectively located on the printhead 20. In a preferred embodiment, the printhead heaters 24 are formed of the same material as the ink firing resistors, and may be formed on the same substrate layer. The printhead heaters 24 are operable to regulate the temperature of the printhead 20, thereby controlling the temperature of the ink contained in the printhead 20. Since the ink droplet mass is a function of the ink temperature, the printhead temperature is a determining factor of the ink droplet mass. Therefore, according to the invention, ink droplet mass is optimized by controlling the printhead temperature according to the current print medium.

According to the preferred embodiment of the invention, the printer controller 12 continually maintains the temperature of the printhead 20 using a closed loop thermal control routine, thereby controlling the size and mass of ink droplets being ejected from the nozzles of the printhead 20 onto the print medium 14. Additionally, by adjusting the temperature of the printhead 20, the ink droplet exit velocity is also controlled. By increasing the temperature of the printhead 20, the ink contained within the printhead 20 is energized, and as a result, the ink droplets' nozzle exit velocity increases proportionally with the printhead temperature. One contributor to ink droplet misdirection is ink having a low energy content, where energy content is proportional to the temperature of the printhead 20. A lower energy content tends to produce lower droplet exit velocities, contributing to the misdirection. As the ink droplet energy and resulting exit velocity increases with increasing printhead temperature, ink droplet misdirection tends to be correspondingly decreased. Consequently, the printer 10 is operable to control the ink droplet mass and exit velocity, thereby printing images on a various types of media 14 without having to reconfigure the nozzle geometry, heater size, or ink chemistry to vary the ink droplet mass or nozzle exit velocity. Each of these latter alternatives for varying the ink droplet mass and exit velocity are expensive and inefficient practices for a particular printing application. Furthermore, according to the invention, the ink droplet mass and exit velocity is continually optimized for the current print medium 14.

Figure 2A:
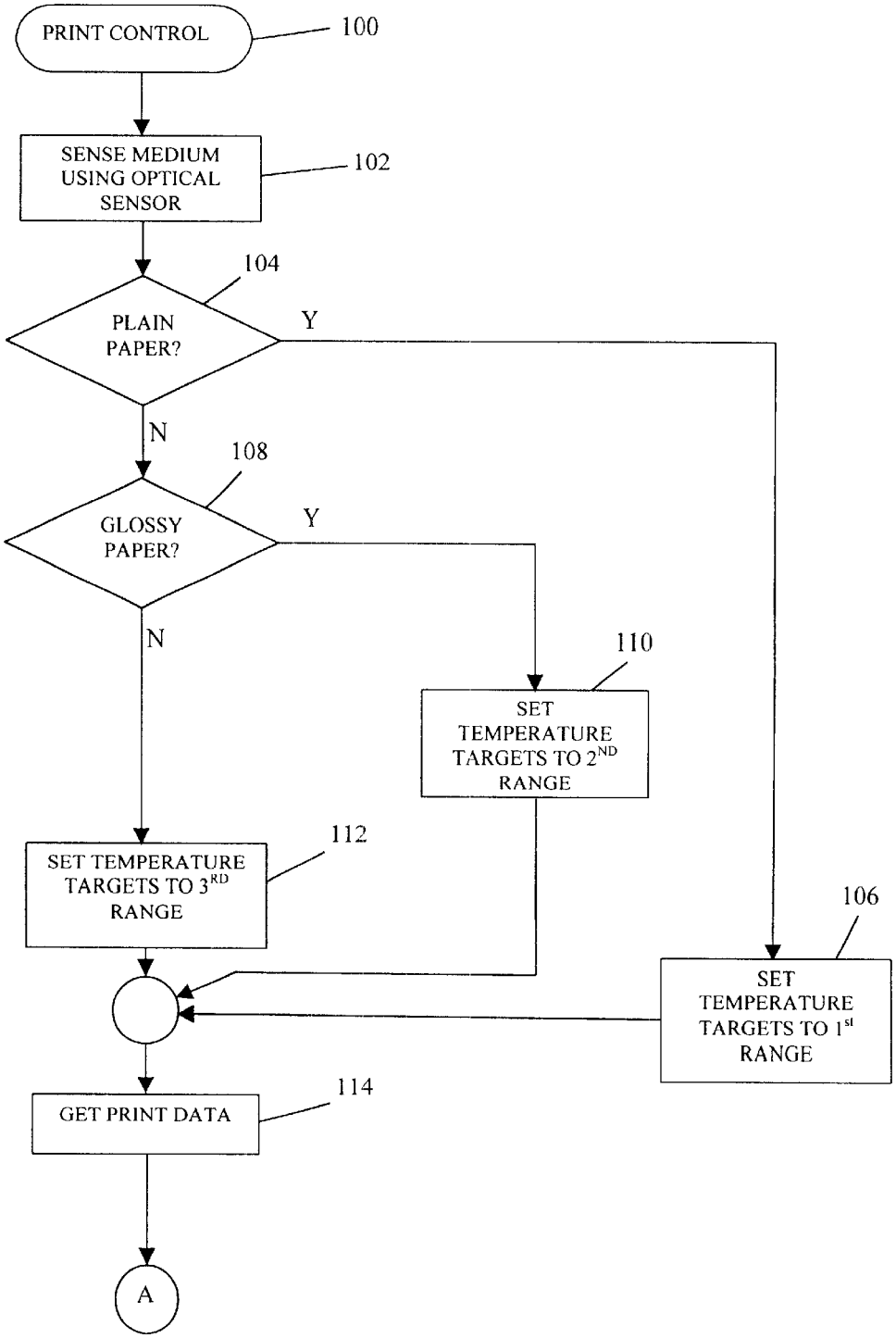
FIGS. 2A–2C depict a method for controlling the ink droplet mass and exit velocity according to a preferred embodiment of the invention; and, FIG. 3 is a graphical representation depicting ink spot size varying with temperature.
Figure 2B:
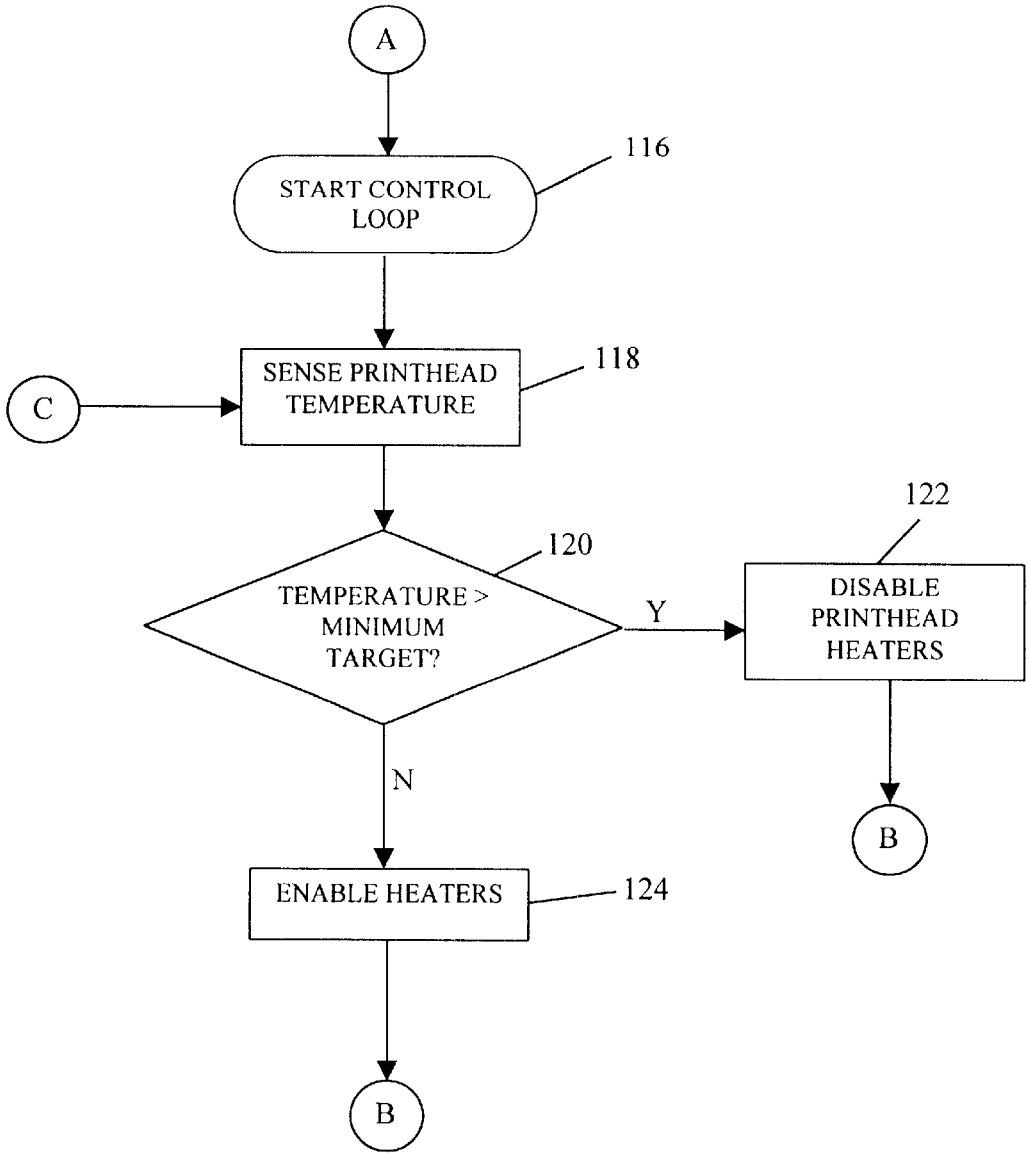
Figure 2C:
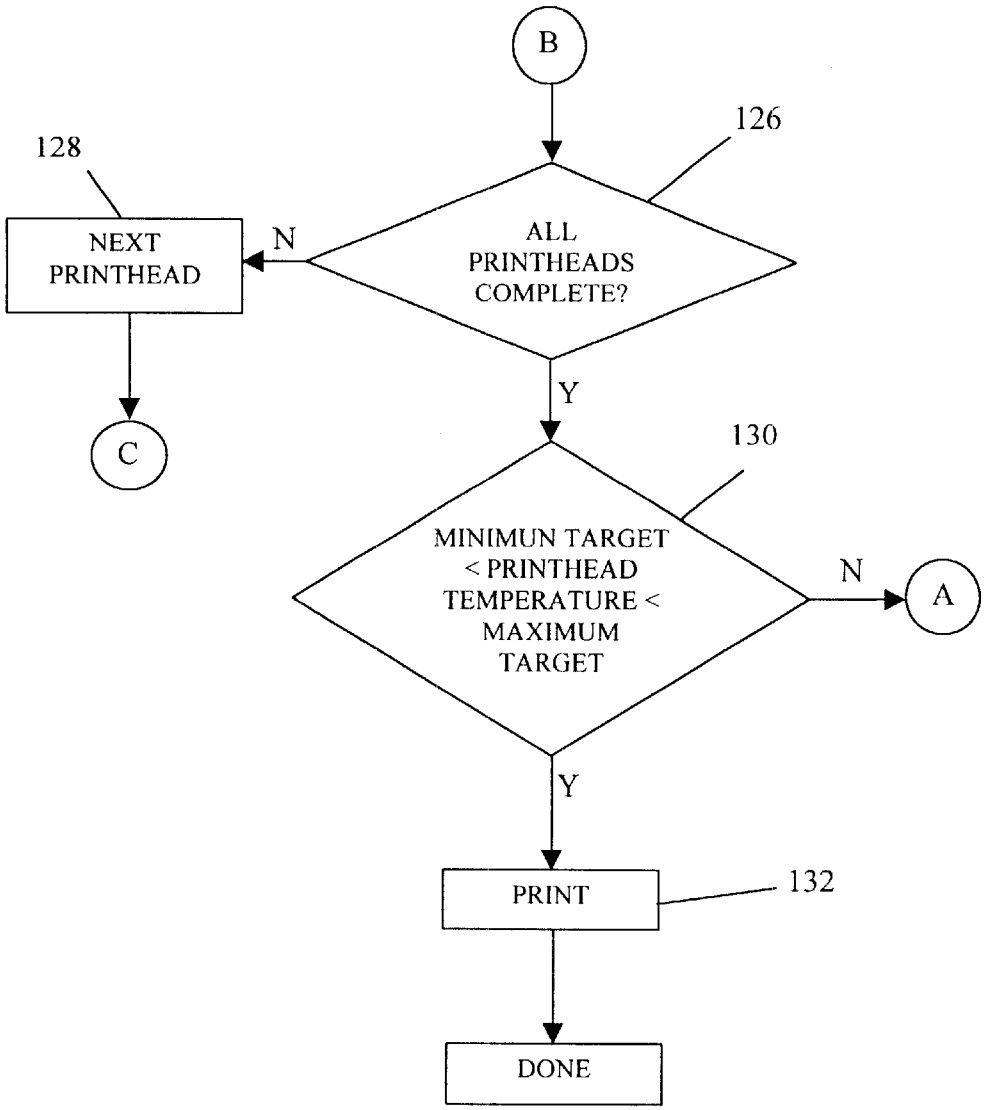

Referring now generally to FIGS. 2A–2C, the operation of a preferred embodiment of the invention will be described. When it is desired to print an image, the host computer sends a signal to printer 10, and the printer 10 is initialized in preparation for printing (step 100). The optical media sensor 16 senses the type of print medium 14 and produces a corresponding print medium signal which is input into the printer controller 12 (step 102). The optical sensor 16 determines the medium type 14 by transmitting an optical signal towards the print medium 14 and measuring the amount of reflectivity based on the reflected signal received by the optical sensor 16 from the print medium 14. Based on the reflected signal, the printer controller 12 determines the amount of light reflected by the print medium 14 and determines the print medium type based on the amount of reflection. As discussed below, the printer controller 12 configures the printer 10 to print according to the sensed medium type 14.

Based on the print medium signal from the optical sensor 16, the printer controller 12 enables a corresponding print mode which defines the resulting print resolution until the optical sensor 16 senses a different medium type 14. In a preferred embodiment of the invention, before enabling the printhead heaters 24 and thereby heating the ink in the printhead 20, the printer controller 12 takes into account the amount of heat generated by the firing resistors during a print swath by predicting their contribution to the printhead temperature. The predicted value is used in calculating minimum and maximum temperature targets for each print mode. At step 104, the optical sensor 16 senses whether a plain type paper is the current print medium 14. Used herein, plain type paper generally refers to paper having ordinary finish properties of paper typically sold for general printing and copying. Correspondingly, the printer controller 12 sets a minimum and a maximum printhead temperature target range for the plain type paper. For plain paper, the minimum temperature target is between about 20° C. and about 25° C. and the maximum temperature target is between about 30° C. and about 35° C. (step 106). The plain paper temperature target range is a preferred range of printhead temperatures at which to maintain the printhead 20 for optimal print quality when printing on plain type media.

Figure 3:
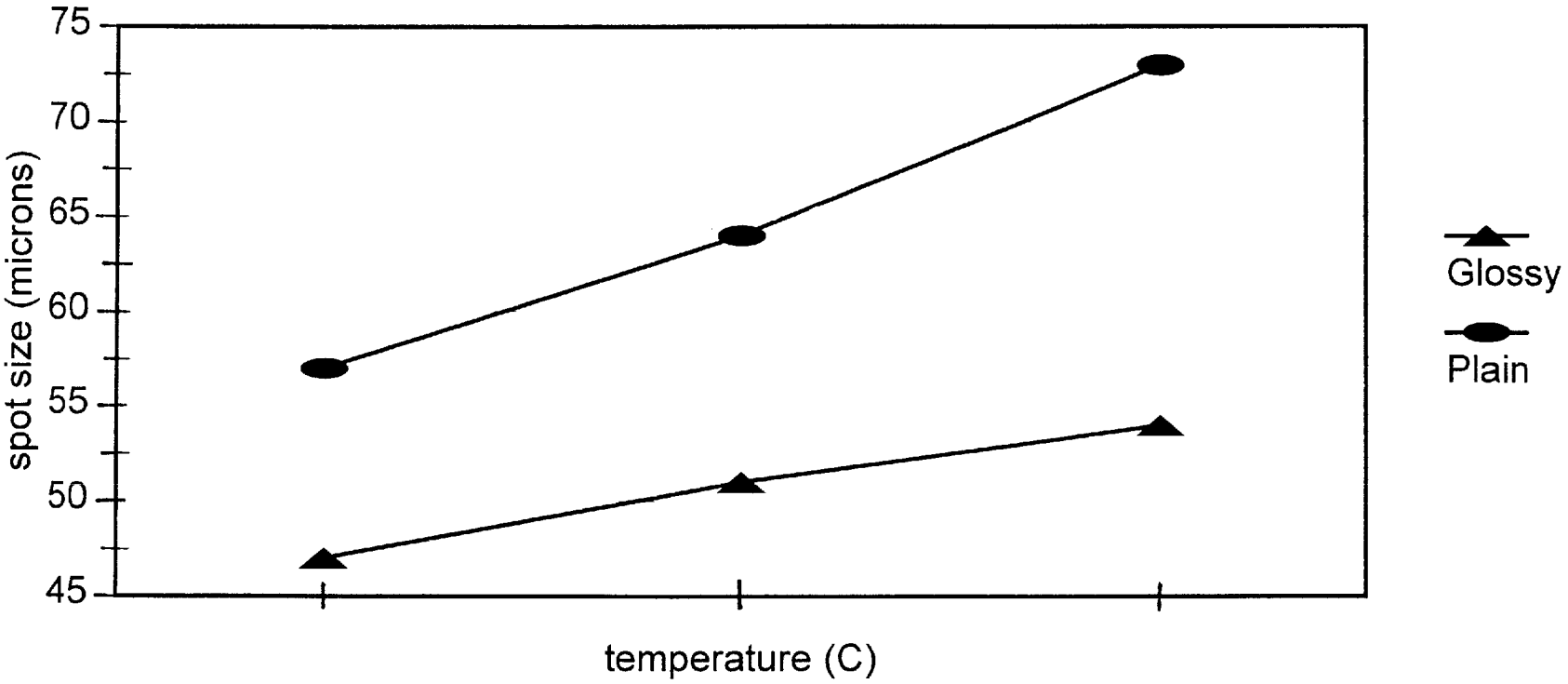

Because ink has a tendency to wick into the fibers of a plain paper type, the plain paper tends to absorb more ink than a glossy type medium. FIG. 3 depicts the differing ink spot size when printing on plain versus glossy paper. For the same temperature, the plain paper has an ink spot size ranging from 22% to 35% larger than for the glossy paper. Accordingly, since the ink spreads more readily on the plain paper, a lesser amount of ink ejected onto the plain type paper will create substantially the same ink spot size as a greater amount of ink ejected onto the glossy type medium. Additionally, the ink droplet exit velocity is proportional to the ink temperature. As a result of the lower printhead temperature, any misdirection of ink droplets which may occur due to the lower printhead temperature is not as critical when printing on plain paper, since the ink tends to spread out more on the plain paper and mask any ink droplet misdirection. Therefore, a correspondingly lower printhead temperature may be used for the plain type medium than for other mediums, without sacrificing print quality.

When the optical sensor 16 detects a glossy type medium (step 108), a corresponding input to the printer controller 12 will set the minimum and a maximum printhead temperature target based on the glossy type medium. The minimum temperature target is between about 35° C. and about 40° C. and the maximum temperature target is between about 45° C. and about 50° C. (step 110). The printhead temperature targets are a preferred range of printhead temperatures at which to maintain the printhead 20 for optimal print quality with the same spot size as was achieved on plain paper. The glossy type paper tends to require more ink to print substantially the same spot size as for plain paper. Glossy type paper refers to glossy or coated type paper having clay or chemical coating. The glossy type paper requires more ink to be ejected from the printhead 10 since the ink droplet spread on the glossy type paper tends to be minimal. Additionally, ink droplet misdirection may be exacerbated when printing on glossy type paper due to the minimal ink droplet spread. The higher printhead temperature tends to lessen any associated misdirection due to the higher ink temperature and resulting higher ink droplet exit velocity from the printhead 20.

Preferably, if the optical sensor 16 does not sense plain paper or glossy type paper as the current print medium 14, the printer controller 12 sets the print targets to an intermediate temperature range (step 112). An example of an intermediate temperature range would have a minimum temperature target of between about 30° C. and about 35° C. and the maximum temperature target of between about 35° C. and about 40° C.

Once the printer controller 12 has set the minimum and maximum printhead temperature targets based on the current print media, the printer controller 12 sends a signal to the host computer instructing the host computer to send the image data to the printer 10 (step 114). The host computer then transmits the image data to the printer 10, wherein the printer controller 12 stores the image data in memory in preparation for printing. Alternatively, the printer 10 may already have stored print data in memory, awaiting instructions for further processing from the printer controller 12.

The printer controller 12 is structured to control the operation of the printer 10 according to an internal timer and associated interrupt structure. When the printer controller 12 determines that it is time to print, the printer controller 12 enables the closed loop thermal control routine (step 116). According to a preferred embodiment of the invention, once the printer 10 begins printing, the closed loop thermal control routine executes about every twenty-five (25) milliseconds according to the internal timer interrupt. Preferably, the printhead temperature is adjusted at about 5 millisecond to about 50 millisecond intervals. For a printer carriage 22 requiring 0.50 seconds to translate across the print medium 14, and a control loop cycle time of 0.25 milliseconds, the closed loop thermal control routine cycles through at least twenty times during a single translation of the carriage, regulating the printhead temperature as required. The printer 10 is not limited to the above described carriage 22 translation speed or control loop interval, but each may be configured according to the preferred printing requirements.

The printer controller 12 utilizes the media sensor input 16 and the temperature sensor 18 input to regulate the temperature of at least one printhead 20 using the closed loop thermal control routine. As a result, the printer 10 is operable to control the ink mass ejected from the nozzles of the printhead 20 by controlling the temperature of the printhead 20 using the closed loop thermal control routine and printhead heaters 24. It is preferred that the printer controller 12 sends a number of voltage pulses to the printhead heaters 24 which, in turn, controls the heat output from the printhead heaters 24. The printer controller 12 is operable to control the duty cycle and number of the pulses to control the heater output and printhead temperature. Since the ink droplet mass varies according to the temperature of the printhead 20, the printer 10 thereby controls the print density of the ejected ink droplets onto the print medium 14 by continually regulating the printhead 20 temperature. Table 1 depicts the effects on drop volume and spot diameter for a population of printheads as a result of using the closed loop thermal control routine utilizing the sensed media type input from the media sensor 16 for a glossy type medium 14.

TABLE 1

| Temperature | Drop Volume | Standard Deviation | Spot Diameter | Standard Deviation | Misdirection | Standard Deviation |
|---|---|---|---|---|---|---|
| +22° C. | 23.2 | 1.5 | 64.8 | 2.1 | 18.6 | 3.6 |
| +37° C. | 28.7 | 1.7 | 79.0 | 8.5 | 14.5 | 4.9 |
| +47° C. | 34.6 | 1.4 | 91.1 | 6.4 | 10.8 | 3.8 |

The first column of Table 1 lists a number of temperatures at which the population of printheads were tested. For the population, columns 2 and 3 show the drop volume average and standard deviation at those temperatures (units of picoliters). As the operating temperature is increased from +22° C. to +47° C., the drop volume increases by 50%. The fourth and fifth columns show the resulting average single drop spot size and the corresponding standard deviation created by these printheads at different temperatures on the same media (units of microns). As the operating temperature is increased from +22° C. to +47° C., the spot diameter increases with increasing drop volume by about 40%, which means that the average paper area covered by a spot has approximately doubled. The sixth and seventh columns show the resultant average misdirection of the drops and the corresponding standard deviations (units of microns). Accordingly, drops fired at higher temperatures have more energy and as a result, the drop velocity increases. Correspondingly, the higher ink drop velocities result in less misdirection of the drops.

Moreover, the ink droplet exit velocity is also controlled according to the invention, since one aspect of the ink droplet exit velocity is determined by the temperature of the printhead 20, which corresponds to the temperature of the ink contained therein. Therefore, based on the sensed medium type 14, the printer controller 12 controls the printhead 20 temperature to achieve the desired print resolution and density without sacrificing print speed or quality.

At step 118, the printer controller 12 receives the temperature sensor signal corresponding to the temperature of printhead 20 from the temperature sensor 18. The printer controller 12 compares the sensed printhead temperature signal to the minimum temperature target according to the current print medium (step 120). For plain paper, if the sensed printhead temperature is greater than the minimum temperature target of between about 25° C. and about 30° C., the printer controller 12 disables the printhead heaters 24 (step 122). For intermediate paper type printing operations, if the sensed printhead temperature is greater than the minimum temperature target of between about 30° C. and about 35° C., again, the printer controller 12 disables the printhead heaters 24 (step 122). Likewise, for glossy or coated paper types, if the sensed printhead temperature is greater than the minimum temperature target of between about 35° C. and about 40° C., the printer controller 12 also disables the printhead heaters 24 (step 122).

If the sensed printhead temperature is less than the minimum temperature target of between about 25° C. and about 30° C. for plain paper types, the printer controller 12 enables the printhead heaters 24 (step 124). For intermediate paper type printing operations, if the sensed printhead temperature is less than the minimum temperature target of between about 30° C. and about 35° C., again, the printer controller 12 enables the printhead heaters 24 (step 124). Similarly, for glossy or coated type paper. if the sensed printhead temperature is less than the minimum temperature target of between about 35° C. and about 40° C., the printer controller 12 enables the printhead heaters 24 (step 124).

In a preferred embodiment of the invention, if the sensed printhead temperature is less than the minimum temperature target for each print mode, the printer controller 12 calculates a printhead heater value based on the temperature difference from the target, and the cooling characteristics of the printhead design. Heat is enabled by varying the voltage pulses sent by the printer controller 12 to the heaters 24, as described above. In the preferred embodiment, this is an 80% duty cycle for the temperatures below 2° C. below target, and a linear interpolation between 2° C. below and the target.

For a printer 10 having more than one printhead 20, the printer controller 12 cycles through each printhead 20 (steps 126 and 128), receiving the current temperature signal from the temperature sensor 18 located adjacent to each printhead 20. The sensed printhead temperature signal is compared to the minimum and maximum temperature targets, as described above and the printhead heaters 24 are enabled or disabled. Once the printer controller 12 has cycled through each printhead 20 (steps 126 and 128), the printer controller 12 determines whether the sensed temperature signal for each printhead 20 is greater than the minimum temperature target and less than the maximum temperature target (step 130). If the printhead temperature is not within the minimum and maximum printhead temperature target range, then the printer controller 12 again cycles through the closed loop thermal control routine at the next timer interrupt (steps 130 and 116). On the other hand, if the printhead temperature is within the maximum and minimum temperature target range, the printer controller 12 instructs the printer 10 to print a swath across the print medium 14 by ejecting ink from the printhead 20 as the carriage 14 translates across the print medium 14 (step 132). The printer controller 12 then reverts back to step 100 and cycles through the print control routine until the image data is completely printed.

Since the printhead temperature is continually sensed and processed by the printer controller 12 to control the printing process, the ink droplet mass and nozzle exit velocity is thereby continually and effectively regulated during printing. As a result, the printer 10 is able to produce a quality printed image on any medium type 14 without having to reconfigure the nozzle geometry, heater size, or ink chemistry. Accordingly, the printer controller 12 is operable to continually regulate at least one printhead temperature based on a sensed medium type 14 and sensed printhead temperature.

Having described various aspects and embodiments of the invention, and several advantages thereof, it will be recognized by those of ordinary skills that the invention is susceptible to various modifications, substitutions and revisions within the spirit and scope of the appended claims. For example, the invention is not limited to the print mode being determined by the optical sensor 16 input. A user may prefer to print an image having a higher resolution and may therefore override the optical sensor 16 input through a menu interface, either on the host computer or on the printer 10 itself. Furthermore, the present invention is not limited to three print modes, but may have more or less depending on the printer 10.

What is claimed is:

1. A method of adjusting characteristics of ink droplets ejected from an inkjet printhead to form dots on a print medium, where the dots printed during multiple passes of the printhead across the print medium form a printed image on the print medium, the method comprising the steps of:

(a) sensing a print medium type, (b) sensing a printhead temperature, (c) determining, based on the print medium type, an optimal temperature range in which to maintain the printhead temperature, (d) maintaining the printhead temperature within the optimal temperature range,and (e) printing the image by ejecting the ink droplets from the printhead as the printhead passes across the print medium to form the printed image.

2. The method of claim 1, wherein step (a) includes using an optical sensor to determine the print medium type.

3. The method of claim 1, wherein step (a) includes using an optical sensor to determine the print medium type by determining the amount of light reflected from the print medium to the optical sensor.

4. The method of claim 1, wherein step (a) includes using a near infra-red optical sensor utilizing a two channel detector to determine the print medium type by comparing amounts of spectral and diffuse reflectivities to a standard.

5. The method of claim 1, wherein step (b) includes determining an ink temperature based on the printhead temperature using at least one temperature sensing device located adjacent the printhead.

6. The method of claim 1, wherein step (d) includes using a closed loop thermal control routine to adjust the printhead temperature.

7. The method of claim 1, wherein step (d) includes heating the printhead using a number of heating elements located adjacent to the printhead.

8. The method of claim 1, wherein step (d) includes adjusting the printhead temperature within the optimal temperature range by enabling or disabling a number of heating elements located adjacent to the printhead.

9. The method of claim 5, wherein the printhead temperature is adjusted at about 5 millisecond and to about 50 millisecond intervals.

10. The method of claim 6, wherein step (d) includes heating the printhead to a low operating temperature for plain paper.

11. The method of claim 6, wherein step (d) includes heating the printhead to an intermediate operating temperature for intermediate media.

12. The method of claim 6, wherein step (d) includes heating the printhead to a high operating temperature for glossy paper.

13. A method of adjusting characteristics of ink droplets ejected from an inkjet printhead to form dots on a print medium, where the dots printed during multiple passes of the printhead across the print medium form a printed image on the print medium, the method comprising the steps of:

(a) sensing a print medium type using an optical sensor and determining the print medium type based on an amount of reflected light received by the optical sensor, (b) providing a print medium signal to the printer controller, (c) sensing a printhead temperature using a temperature sensing device located adjacent the printhead, (d) providing a printhead temperature signal to the printer controller, (e) determining, based on the print medium type, an optimal temperature range in which to maintain the printhead temperature to maximize print quality, (f) maintaining the printhead temperature within the optimal temperature range using a closed loop thermal control routine executing at a regular interval to adjust the printhead temperature by enabling or disabling a number of heating elements located adjacent to the printhead, and (f) printing the image by ejecting the ink droplets from the printhead as the printhead passes across the print medium to form the printed image.

14. A printing apparatus for printing a desired image having a spatial resolution onto a print medium, the printing apparatus comprising:

a printhead having a plurality of printing elements for ejecting ink droplets having a mass onto the print medium, a temperature sensor for sensing a temperature of the printhead and producing a temperature signal, a media sensor for determining a type of print medium is loaded in the printer, and for producing a print medium signal based on the type of print medium installed in the printer, a plurality of heating devices located adjacent the printhead for adjusting the temperature of the printhead, and a printer controller for receiving the temperature signal from the temperature sensor and the print medium signal from the media sensor, for determining a desired ink temperature based on the print medium signal, and for activating the heating devices to maintain the temperature of the printhead within a desired temperature range that is dependent upon the print medium signal.

15. The printing apparatus of claim 14, wherein the media sensor is a near infra-red optical sensor utilizing a dual channel detector to determine the print medium type by comparing amounts of spectral and diffuse reflectivities to a standard.

16. The printing apparatus of claim 14, wherein the media sensor is an optical sensor operable to sense the media type by determining an amount of light reflection based on a first signal directed at the print medium and a second received by the optical sensor from the print medium.

17. The printing apparatus of claim 14, wherein the temperature sensor is a thermistor type temperature sensor adjacently located to the printhead.

18. The printing apparatus of claim 14, wherein the plurality of heating devices comprises a plurality of resistive heating elements selectively located on the printhead for adjusting the temperature the printhead.

19. The printing apparatus of claim 14, wherein the media sensor produces a plain paper signal and the printer controller adjusts a minimum and a maximum printhead temperature target which is a low controllable temperature based on the plain paper signal.

20. The printing apparatus of claim 14, wherein the media sensor produces a glossy paper signal and the printer controller adjusts a minimum and a maximum printhead temperature target which is a high controllable temperature based on the glossy paper signal.

* * * * *